US011177083B1

(12) United States Patent
Wu et al.

(10) Patent No.: US 11,177,083 B1
(45) Date of Patent: Nov. 16, 2021

(54) KEY STRUCTURE

(71) Applicant: Primax Electronics Ltd., Taipei (TW)

(72) Inventors: Ming-Han Wu, Taipei (TW); Che-Wei Yang, Taipei (TW); Yi-Wei Chen, Taipei (TW); Chien-Hung Liu, Taipei (TW); Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/161,153

(22) Filed: Jan. 28, 2021

(30) Foreign Application Priority Data

Nov. 25, 2020 (TW) ..... 109141337

(51) Int. Cl.
*H01H 3/12* (2006.01)
*H01H 13/10* (2006.01)
*H01H 13/705* (2006.01)

(52) U.S. Cl.
CPC ..... *H01H 3/122* (2013.01); *H01H 13/10* (2013.01); *H01H 13/705* (2013.01)

(58) Field of Classification Search
CPC ..... H01H 3/125; H01H 13/705; H01H 13/14; H01H 13/70; H01H 13/704; H01H 13/7065; H01H 13/7006; H01H 13/7057; H01H 13/78; H01H 13/79; H01H 13/52; H01H 13/703; H01H 13/507
See application file for complete search history.

(56) References Cited

U.S. PATENT DOCUMENTS

| | | | | |
|---|---|---|---|---|
| 10,971,314 | B2 * | 4/2021 | Chiang | H01H 11/0018 |
| 2006/0000694 | A1 * | 1/2006 | Nishino | H01H 3/122 200/5 A |
| 2012/0199458 | A1 * | 8/2012 | Takemae | H01H 13/14 200/5 A |
| 2014/0138228 | A1 * | 5/2014 | Chen | H01H 13/83 200/5 A |

* cited by examiner

*Primary Examiner* — Ahmed M Saeed
(74) *Attorney, Agent, or Firm* — Kirton McConkie; Evan R. Witt

(57) ABSTRACT

A key structure includes a keycap, a base plate and a wing-type supporting element. When the keycap is depressed in response to an external force, a first frame and a second frame of the wing-type supporting element are pushed by each other through protrusion structures and rotating shafts. Consequently, the first frame and the second frame can be swung relative to the base plate.

17 Claims, 11 Drawing Sheets

KEY STRUCTURE

FIELD OF THE INVENTION

The present invention relates to the structure of an input device, and more particularly to a key structure.

BACKGROUND OF THE INVENTION

In modern societies, electronic products become indispensable parts in human lives. The electronic products are applied in many sectors, including food, clothing, housing, transportation, education and entertainment. Generally, the electronic product comprises a keyboard. Nowadays, the trends of designing the keyboard are toward miniaturization and low fabricating cost. For example, the manufacturer of the keyboard tries to simplify the design of the supporting element of the key structure in order to minimizing the size of the keyboard.

The simplified supporting element can reduce the fabricating cost and ease the assembling process of the key structure. However, since the supporting element is simplified, the keycap of the key structure is possibly unable to be stably ascended or descended. Under this circumstance, the tactile feel of pressing down the key structure is deteriorated.

Therefore, there is a need of providing a key structure that is easily assembled and provides satisfied tactile feel.

SUMMARY OF THE INVENTION

The present invention provides a key structure that is easily assembled and provides satisfied tactile feel.

In accordance with an aspect of the present invention, a key structure is provided. The key structure includes a keycap, a base plate and at least one wing-type supporting element. The at least one wing-type supporting element is connected with the keycap and the base plate. The keycap is movable upwardly or downwardly relative to the base plate through the at least one wing-type supporting element. The wing-type supporting element includes a first frame and a second frame. The first frame includes a first end part and a second end part opposed to the first end part. The first end part includes a first protrusion structure and a first rotating shaft. The second frame includes a third end part and a fourth end part opposed to the third end part. The third end part includes a second protrusion structure corresponding to the first rotating shaft and a second rotating shaft corresponding to the first protrusion structure. The second end part and the fourth end part are slidably connected with the keycap. The first end part and the third end part are located beside each other and pivotally coupled to the base plate. The first rotating shaft and the second rotating shaft are respectively contacted with the second protrusion structure and the first protrusion structure. When the keycap is depressed in response to an external force, the second rotating shaft and the first rotating shaft are respectively pushed by the first protrusion structure and the second protrusion structure, so that the first frame and the second frame are swung relative to the base plate.

In an embodiment, the first protrusion structure includes a first recess, and the second protrusion structure includes a second recess. When the keycap is not depressed in response to the external force, the first rotating shaft and the second rotating shaft are respectively engaged with the second recess and the first recess. When the keycap is depressed in response to the external force and the keycap is moved to a lowermost position, the first rotating shaft and the second rotating shaft are respectively disengaged from the second recess and the first recess.

In an embodiment, at least two position-limiting ribs are disposed on a bottom surface of the keycap, and each position-limiting rib has a first position-limiting slant.

In an embodiment, each of the second end part and the fourth end part includes a second position-limiting slant corresponding to the first position-limiting slant. When the keycap is not depressed in response to the external force, the first position-limiting slants and the corresponding second position-limiting slants are contacted with each other, so that the keycap is not rocked along a horizontal direction.

In an embodiment, two coupling structures are protruded upwardly from the base plate and aligned with each other, and one first pivotal hole and one second pivotal hole in a side-by-side arrangement are formed in each of the two coupling structures.

In an embodiment, two first pivotal shafts are respectively formed on two opposite inner surfaces of the first end part, two second pivotal shafts are respectively formed on two opposite inner surfaces of the third end part, the two first pivotal shafts are respectively penetrated through the corresponding first pivotal holes, and the two second pivotal shafts are respectively penetrated through the corresponding second pivotal holes.

In an embodiment, the wing-type supporting element further includes a connecting seat. The first end part and the third end part are pivotally coupled to the connecting seat, and the connecting seat is fixed on the base plate.

In an embodiment, the connecting seat has a first lateral surface and a second lateral surface, and the first lateral surface and the second lateral surface are opposed to each other. Moreover, one first pivotal hole and one second pivotal hole in a side-by-side arrangement are formed in each of the first lateral surface and the second lateral surface of the connecting seat.

In an embodiment, two first pivotal shafts are respectively formed on two opposite inner surfaces of the first end part, two second pivotal shafts are respectively formed on two opposite inner surfaces of the third end part, the two first pivotal shafts are respectively penetrated through the corresponding first pivotal holes, and the two second pivotal shafts are respectively penetrated through the corresponding second pivotal holes.

In an embodiment, the connecting seat further has a third lateral surface and a fourth lateral surface, and the third lateral surface and the fourth lateral surface are opposed to each other. Moreover, at least two locking grooves are formed in each of the third lateral surface and the fourth lateral surface of the connecting seat, and one locking post is disposed within each locking groove.

In an embodiment, plural hook structures are protruded upwardly from the base plate and aligned with the corresponding locking grooves. The hook structures are penetrated through the corresponding locking grooves and engaged with the corresponding locking posts, so that the connecting seat is fixed on the base plate.

In an embodiment, the connecting seat further has a third lateral surface and a fourth lateral surface, and the third lateral surface and the fourth lateral surface are opposed to each other. Moreover, at least one receiving recess is formed in each of the third lateral surface and the fourth lateral surface of the connecting seat and aligned with the corresponding position-limiting ribs. When the keycap is depressed in response to the external force and the keycap is moved to the lowermost position, each position-limiting rib is accommodated within the corresponding receiving recess, so that the at least two position-limiting ribs and the connecting seat are not interfered by each other.

In an embodiment, two first sliding grooves are respectively formed in two opposite lateral surfaces of the first frame, and two second sliding grooves are respectively formed in two opposite lateral surfaces of the second frame.

In an embodiment, the key structure further includes at least one first linkage bar, and the first linkage bar includes a transverse bar part and two branch bar parts. The two branch bar parts are perpendicular to the transverse bar part and respectively connected to two ends of the transverse bar part. A distant end of each branch bar part includes a bent segment. The bent segment is in parallel with the transverse bar part.

In an embodiment, the transverse bar part is pivotally coupled to the keycap, and each bent segment is inserted into the corresponding first sliding groove or the corresponding second sliding groove.

In an embodiment, at least one locking part is formed on a bottom surface of the keycap, and the transverse bar part is penetrated through the at least one locking part, so that the transverse bar is rotatable relative to the keycap.

In an embodiment, the key structure further includes at least one second linkage bar, and the second linkage bar includes a transverse bar part and two branch bar parts. The two branch bar parts are perpendicular to the transverse bar part and respectively connected to two ends of the transverse bar part. The two branch bar parts are inserted into the corresponding first sliding groove and the corresponding second sliding groove, respectively.

In an embodiment, a first movable hook and a second movable hook are disposed on a bottom surface of the keycap. The second end part is slidably engaged with the first movable hook. The fourth end part is slidably engaged with the second movable hook.

From the above descriptions, the present invention provides the key structure. The position-limiting ribs on the bottom surface of the keycap are contacted with the corresponding position-limiting slants of the wing-type supporting element. Consequently, the rocking condition of the keycap along the horizontal direction is avoided, and the stability of depressing the keycap is enhanced. Moreover, the protrusion structures and the corresponding rotating shafts of the wing-type supporting element are pushed by each other. While the first frame and the second frame of the wing-type supporting element are swung, the swinging angles of the first frame and the second frame are continuously equal. Since the keycap can be ascended or descended stably and not aslant moved, the operation of the key structure provides good tactile feel.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
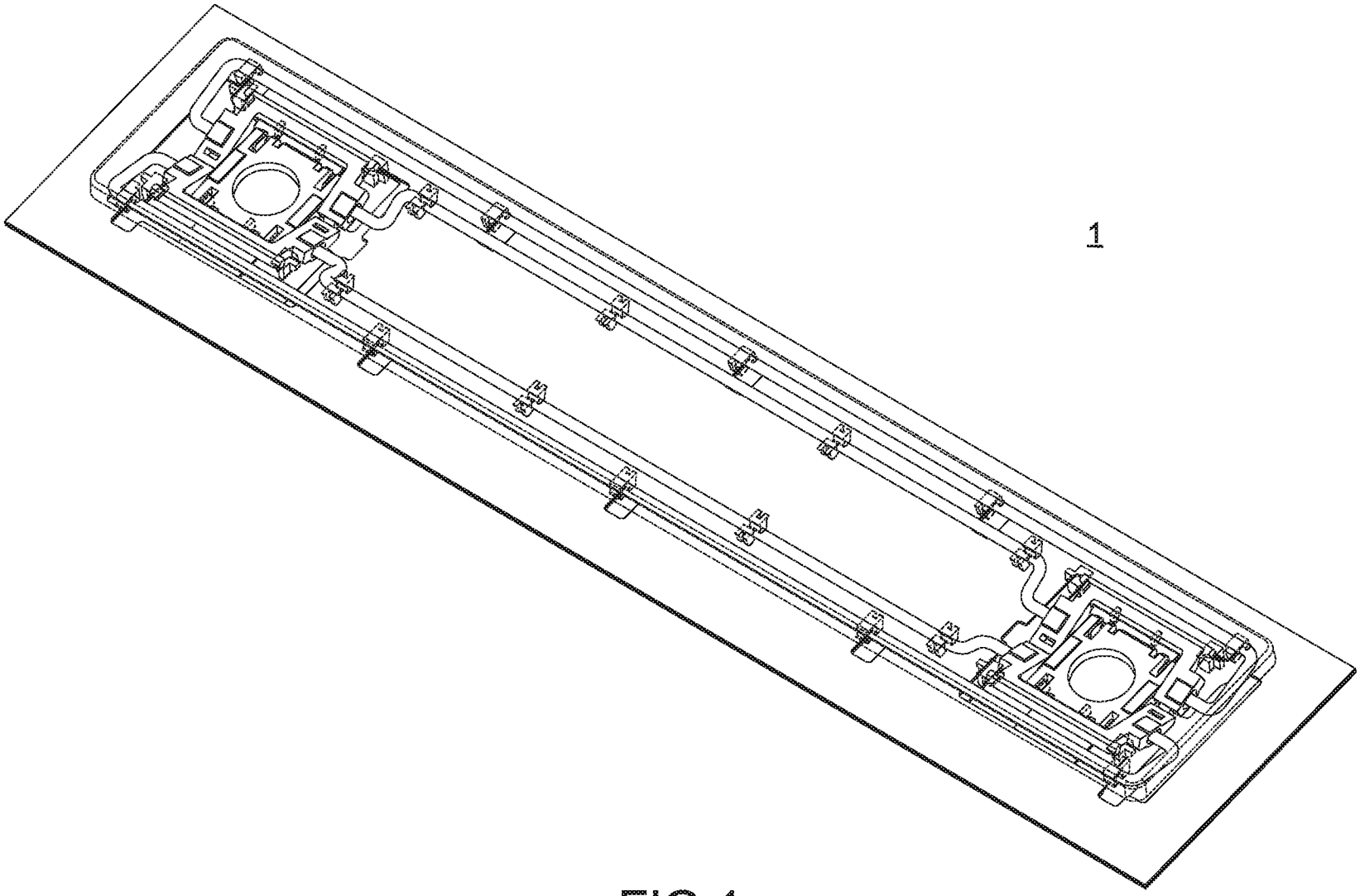
FIG. 1 is a schematic perspective view illustrating a key structure according to a first embodiment of the present invention.
Figure 2A:
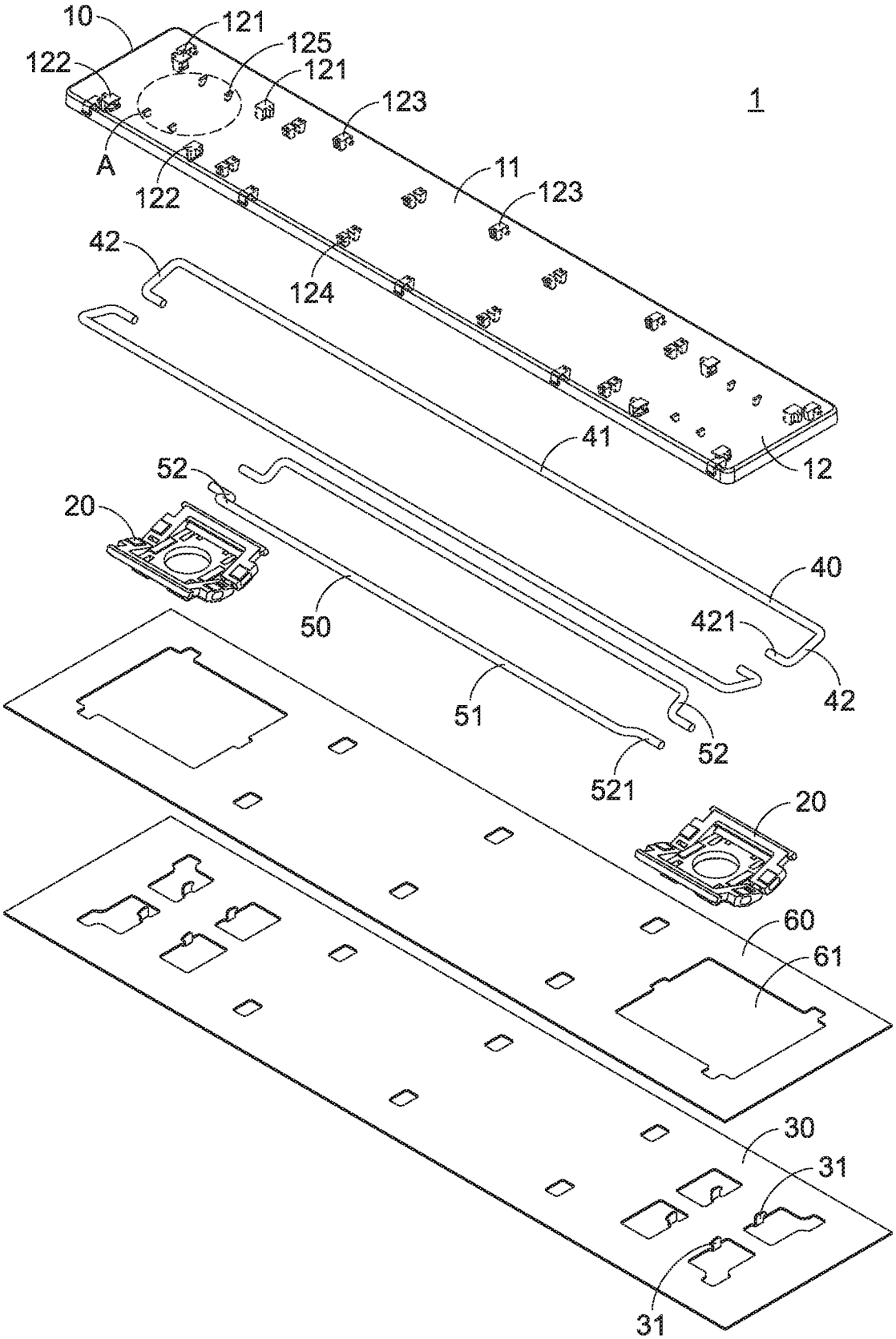
FIG. 2A is a schematic exploded view illustrating the key structure according to the first embodiment of the present invention and taken along a viewpoint.
Figure 2B:
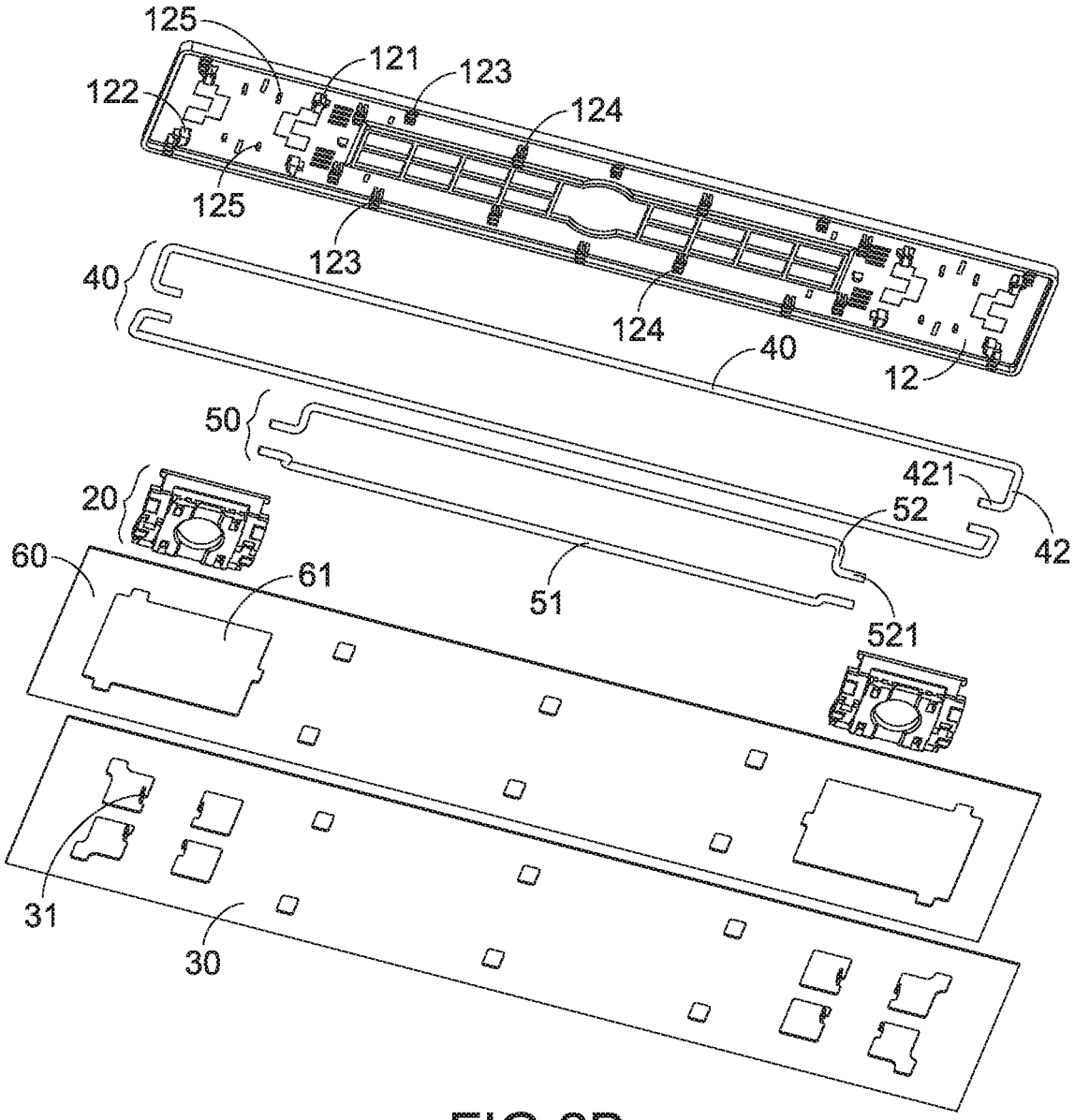
FIG. 2B is a schematic exploded view illustrating the key structure according to the first embodiment of the present invention and taken along another viewpoint.
Figure 2C:
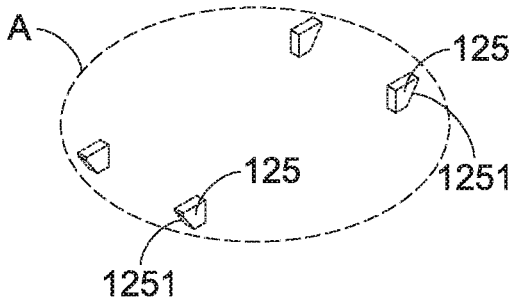
FIG. 2C is a schematic enlarged view illustrating the region A as shown in FIG. 2A.

Please refer to FIGS. 1, 2A, 2B and 2C. FIG. 1 is a schematic perspective view illustrating a key structure according to a first embodiment of the present invention. FIG. 2A is a schematic exploded view illustrating the key structure according to the first embodiment of the present invention and taken along a viewpoint. FIG. 2B is a schematic exploded view illustrating the key structure according to the first embodiment of the present invention and taken along another viewpoint. FIG. 2C is a schematic enlarged view illustrating the region A as shown in FIG. 2A. In this embodiment, the key structure 1 comprises a keycap 10, at least one wing-type supporting element 20, a base plate 30, first linkage bars 40, 50 and a membrane circuit board 60.

The keycap 10 has a top surface 11 and a bottom surface 12, which are opposed to each other. Moreover, plural first movable hooks 121, plural second movable hooks 122, plural locking parts 123, 124 and plural position-limiting ribs 125 are disposed on the bottom surface 12. As shown in FIG. 2C, an end of each position-limiting rib 125 away from the bottom surface 12 of the keycap 10 has a first position-limiting slant 1251. Moreover, the first position-limiting slants 1251 of two corresponding position-limiting ribs 125 are arranged in the direction away from each other. In this embodiment, the key structure 1 is an elongated key structure with two wing-type supporting elements 20. Each key structure 1 is aligned with four corresponding position-limiting ribs 125 and the first movable hooks 121 and the second movable hooks 122 around the corresponding position-limiting ribs 125. The plural locking parts 123 are arranged beside a skirt structure of the keycap 10. The plural locking parts 124 are disposed on a middle region of the bottom surface of the keycap 10.

Moreover, plural hook structures 31 are protruded upwardly from the base plate 30. These hook structures 31 are divided into two groups. Each group contains four hook structures 31. The membrane circuit board 60 is installed on the base plate 30. The membrane circuit board 60 has two openings 61 corresponding to the hook structures 31. After the hook structures 31 are penetrated through the corresponding openings 61, the hook structures 31 are coupled with the corresponding wing-type supporting elements 20. Since the keycap 10 and the base plate 30 are connected with each other through the wing-type supporting elements 20, the keycap 10 is movable upwardly or downwardly relative to the base plate 30. Moreover, an elastomer (not shown) is installed on the membrane circuit board 60. The elastomer provides an elastic restoring force to the keycap 10.

Please refer to FIGS. 2A and 2B again. Each of the first linkage bars 40 comprises a long transverse bar part 41 and two branch bar parts 42. The two branch bar parts 42 are perpendicular to the transverse bar part 41 and respectively connected with two ends of the transverse bar part 41. The distant end of the branch bar part 42 comprises a bent segment 421. The bent segment 421 is in parallel with the transverse bar part 41. Similarly, each of the first linkage bars 50 comprises a long transverse bar part 51 and two branch bar parts 52. The two branch bar parts 52 are perpendicular to the transverse bar part 51 and respectively connected with two ends of the transverse bar part 51. The distant end of the branch bar part 52 comprises a bent segment 521. The bent segment 521 is in parallel with the transverse bar part 51. In this embodiment, the first linkage bars 40 are arranged around the two wing-type supporting elements 20, and the first linkage bars 50 are arranged between the two wing-type supporting elements 20. The transverse bar parts 41 of the first linkage bars 40 are penetrated through the corresponding locking parts 123. The transverse bar parts 51 of the first linkage bars 50 are penetrated through the corresponding locking parts 124. Consequently, the transverse bar parts 41 and 45 are pivotally coupled to the bottom surface of the keycap 10 and rotatable relative to the keycap 10. Moreover, the bent segments 421 and 521 of the branch bar parts 42 and 52 are slidably penetrated through the corresponding wing-type supporting elements 20. Consequently, the first linkage bars 40 and 50 are linked with the wing-type supporting elements 20 to facilitate the keycap 10 to be ascended or descended more stably.

In this embodiment, the keycap 1 comprises two first linkage bars 40 and two first linkage bars 50. It is noted that the number of the first linkage bars 40 and 50 may be varied according to the width or the structural strength of the key structure. For example, in another embodiment, the key structure is equipped with one first linkage bar 40 or one first linkage bar 50. Alternatively, the key structure is not equipped with any first linkage bar.

Figure 3A:
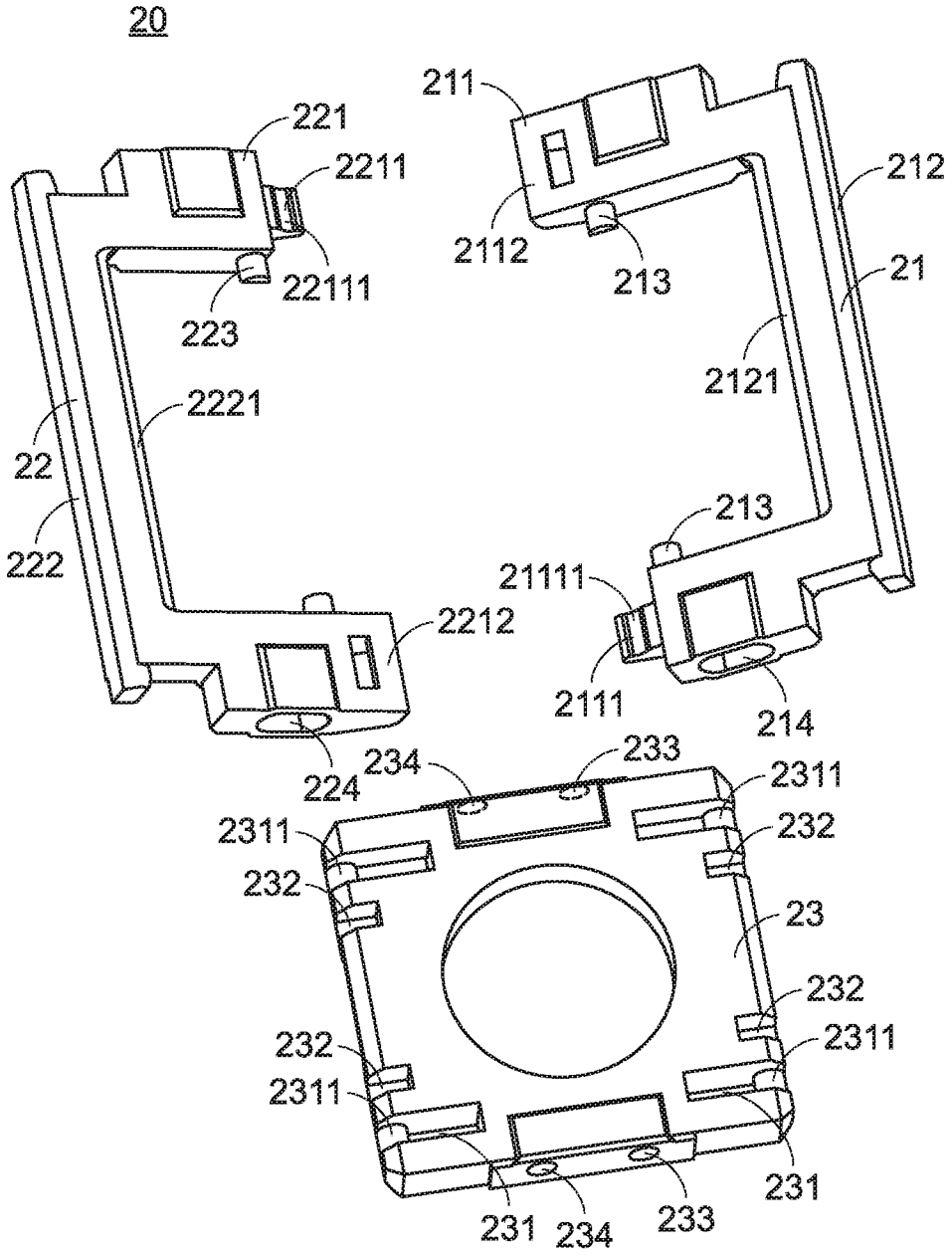
FIG. 3A is a schematic exploded view illustrating a first exemplary wing-type supporting element used in the key structure according to embodiment of the present invention.
Figure 3B:
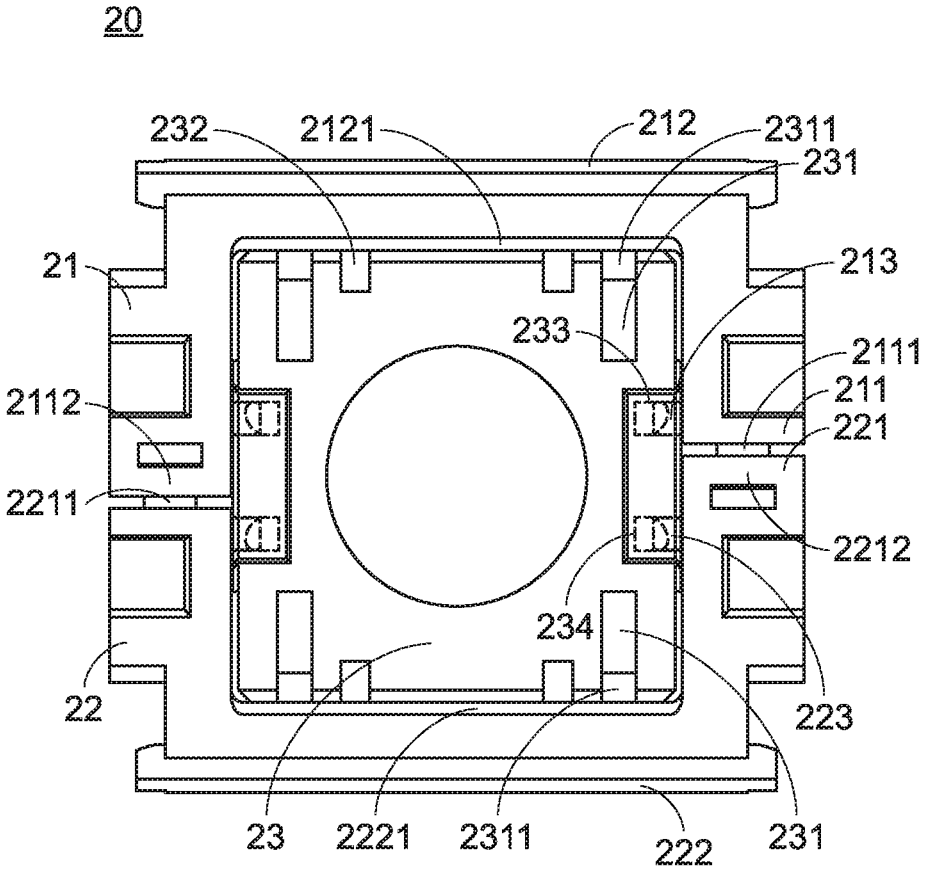
FIG. 3B is a schematic top view illustrating the wing-type supporting element as shown in FIG. 3A.

Please refer to FIGS. 3A and 3B. FIG. 3A is a schematic exploded view illustrating a first exemplary wing-type supporting element used in the key structure according to embodiment of the present invention. FIG. 3B is a schematic top view illustrating the wing-type supporting element as shown in FIG. 3A. In this embodiment, the wing-type supporting element 20 comprises a first frame 21, a second frame 22 and a connecting seat 23. The first frame 21 and the second frame 22 are substantially U-shaped.

The first frame 21 has a first end part 211 and a second end part 212, which are opposed to each other. The second end part 212 is slidably engaged with the first movable hooks 121 (as shown in FIG. 2A). The two sides of the first end part 211 are equipped with a first protrusion structure 2111 and a first rotating shaft 2112, respectively. A first recess 21111 is formed in a top surface of the first protrusion structure 2111. Moreover, two first pivotal shafts 213 are respectively formed on two opposite inner surfaces of the first end part 211. Moreover, two first sliding grooves 214 are respectively formed in two opposite lateral surfaces of the first frame 21 and at the positions close to the first end part 211. The bent segment 421 of the corresponding first linkage bars 40 (as shown in FIG. 2A) is inserted into the outer first sliding groove 214. The bent segment 521 of the corresponding first linkage bars 50 (as shown in FIG. 2A) is inserted into the inner first sliding groove 214. Moreover, the second end part 212 has second position-limiting slants 2121 corresponding to the first position-limiting slants 1251.

The second frame 22 has a third end part 221 and a fourth end part 222, which are opposed to each other. The fourth end part 222 is slidably engaged with the second movable hooks 122 (as shown in FIG. 2A). The two sides of the third end part 221 are equipped with a second protrusion structure 2211 and a second rotating shaft 2212, respectively. A second recess 22111 is formed in a top surface of the second protrusion structure 2211. Moreover, two second pivotal shafts 223 are respectively formed on two opposite inner surfaces of the third end part 221. Moreover, two second sliding grooves 224 are respectively formed in two opposite lateral surfaces of the second frame 22 and at the positions close to the third end part 221. The bent segment 421 of the corresponding first linkage bars 40 (as shown in FIG. 2A) is inserted into the outer second sliding groove 224. The bent segment 521 of the corresponding first linkage bars 50 (as shown in FIG. 2A) is inserted into the inner second sliding groove 224. Moreover, the fourth end part 222 also has second position-limiting slants 2221 corresponding to the first position-limiting slants 1251.

In this embodiment, the second protrusion structure 2211 of the third end part 221 is aligned with the first rotating shaft 2112 of the first end part 211, and the second rotating shaft 2212 of the third end part 221 is aligned with the first protrusion structure 2111 of the first end part 211.

The connecting seat 23 has a first lateral surface, a second lateral surface, a third lateral surface and a fourth lateral surface. The first lateral surface and the second lateral surface are opposed to each other. One first pivotal hole 233 and one second pivotal hole 234 in a side-by-side arrangement are formed in each of the first lateral surface and the second lateral surface of the connecting seat 23. The third lateral surface and the fourth lateral surface are opposed to each other. Two locking grooves 231 and two receiving recesses 232 (corresponding to the position-limiting ribs 125) are formed in each of the third lateral surface and the fourth lateral surface of the connecting seat 23. Moreover, one locking post 2311 is disposed within each locking groove 231. The two first pivotal shafts 213 on the first end part 211 of the first frame 21 are inserted into the corresponding first pivotal holes 233 of the connecting seat 23. The two second pivotal shafts 223 on the third end part 221 of the second frame 22 are inserted into the corresponding second pivotal holes 234 of the connecting seat 23. Consequently, the first frame 21 and the second frame 22 can be swung relative to the connecting seat 23 in a wing-swinging manner.

Figure 4:
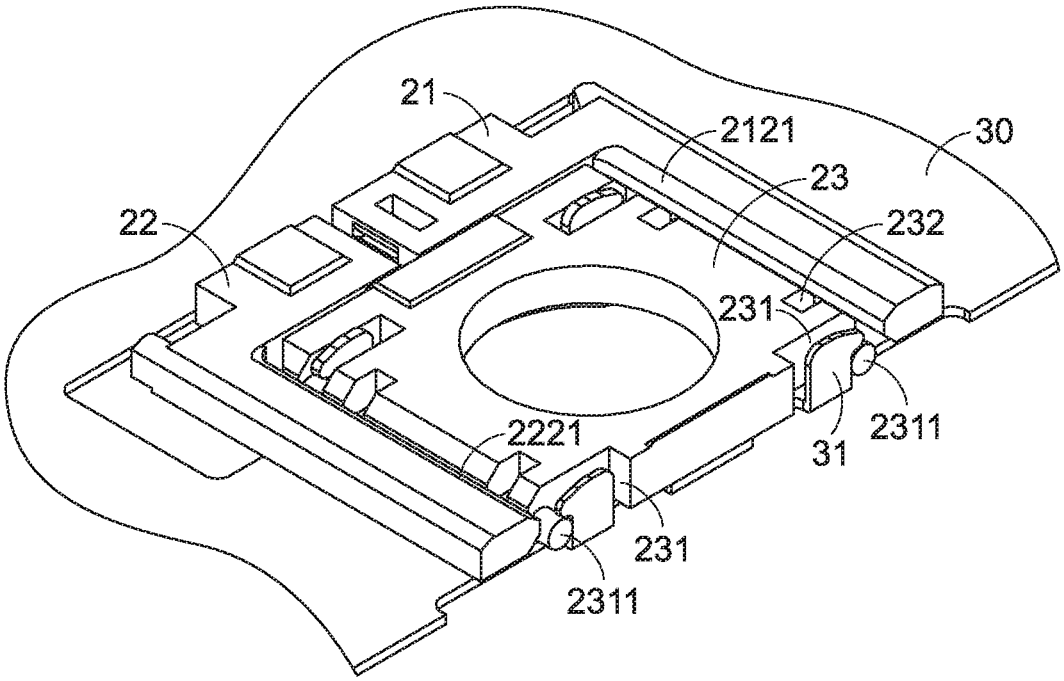
FIG. 4 is a schematic cutaway view illustrating the installation of the first exemplary wing-type supporting element.

Please refer to FIGS. 2A and 4. FIG. 4 is a schematic cutaway view illustrating the installation of the first exemplary wing-type supporting element. As shown in FIG. 4, the four hook structures 31 on the base plate 30 are protruded upwardly and penetrated through the corresponding locking grooves 231. In addition, the inner sides of the hook structures 31 are engaged with the corresponding locking posts 2311. Consequently, the connecting seat 23 is fixed on the base plate 30.

Figure 5:
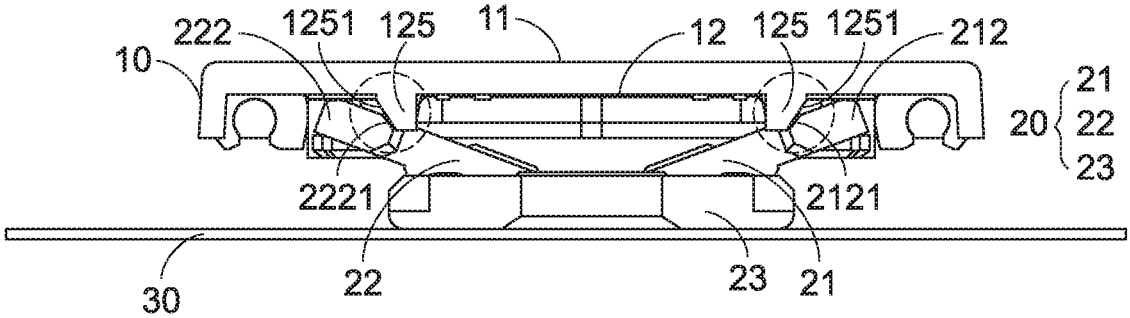
FIG. 5 is a schematic cross-sectional view of the key structure according to the first embodiment of the present invention.

Please refer to FIG. 5. FIG. 5 is a schematic cross-sectional view of the key structure according to the first embodiment of the present invention. When no external force is applied to the keycap 10, the first position-limiting slants 1251 of the position-limiting ribs 125 on the bottom surface of the keycap 10 are contacted with the corresponding second position-limiting slants 2121 of the second end part 212 of the first frame 21 and the corresponding second position-limiting slants 2221 of the fourth end part 222 of the second frame 22. Consequently, the rocking condition of the keycap 10 along the horizontal direction is avoided, and the stability of depressing the keycap 10 is enhanced. In the above embodiment, four position-limiting ribs 125 are located over each wing-type supporting element 20. It is noted that the number of the position-limiting ribs 125 is not restricted. For example, in another embodiment, only two position-limiting ribs 125 are located over each wing-type supporting element 20. Similarly, the first position-limiting slants 1251 of the two position-limiting ribs 125 are arranged in the direction away from each other. Consequently, the efficacy of avoiding the rocking condition of the keycap 10 can also be enhanced.

Figure 6:
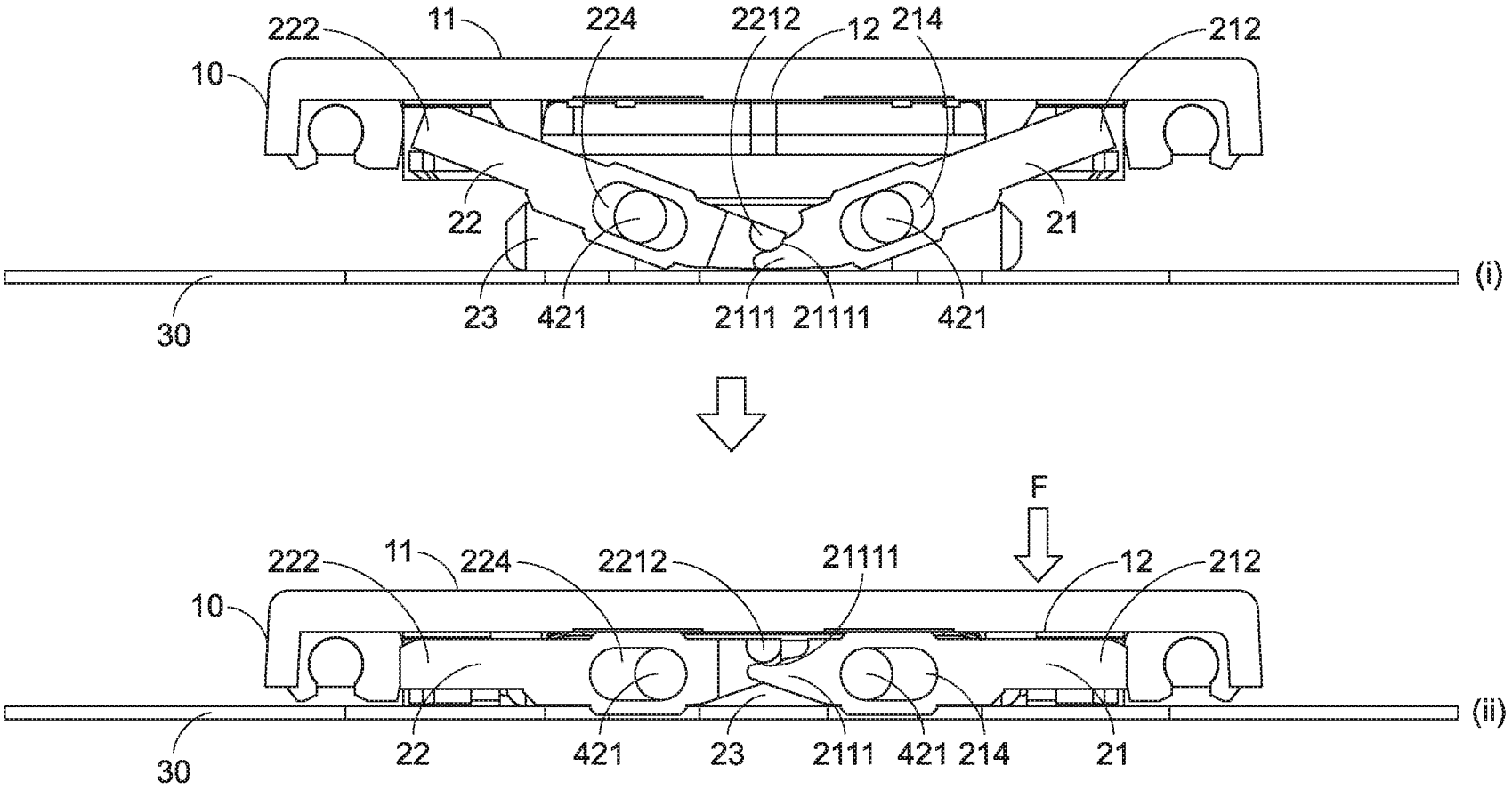
FIG. 6 is a schematic cross-sectional view illustrating the actions of the key structure according to the first embodiment of the present invention.
Figure 7:
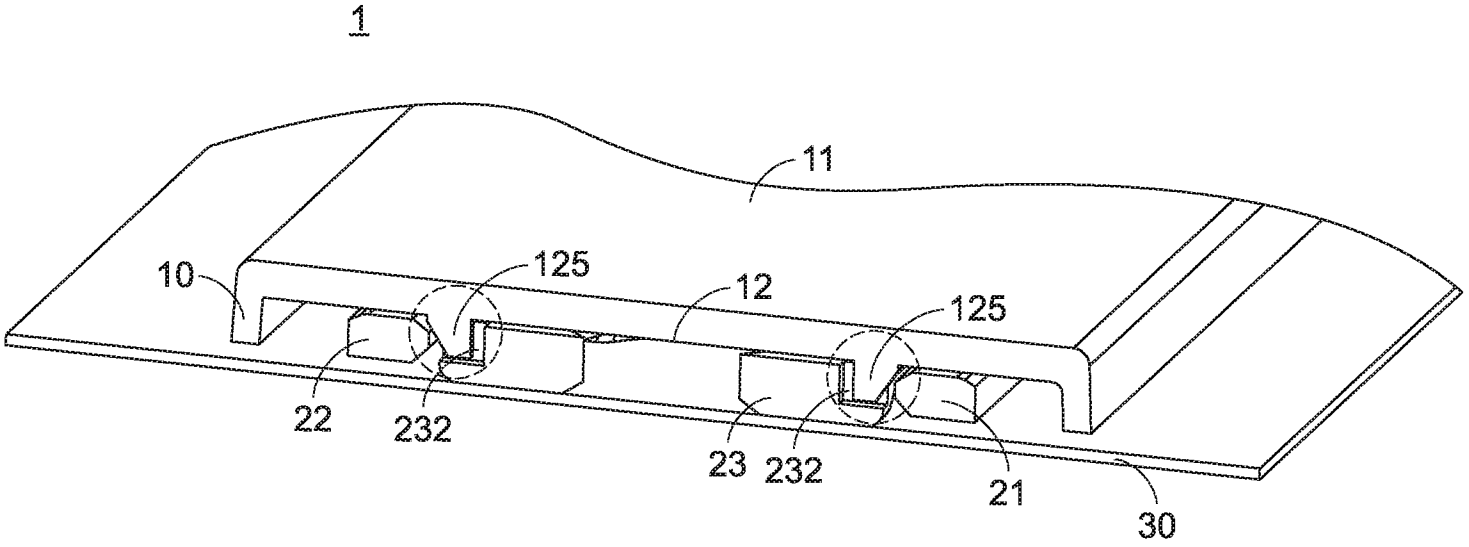
FIG. 7 is a schematic cutaway view illustrating the relationship between associated components of the key structure when the keycap is moved to the lowermost position.

Please refer to FIGS. 2A, 3A, 6 and 7. FIG. 6 is a schematic cross-sectional view illustrating the actions of the key structure according to the first embodiment of the present invention. FIG. 7 is a schematic cutaway view illustrating the relationship between associated components of the key structure when the keycap is moved to the lowermost position.

Please refer to FIG. 6(*i*). When the no external force is applied to the keycap 10, the second rotating shaft 2212 of the second frame 22 and the first recess 21111 of the first protrusion structure 2111 of the first end part 211 are engaged with each other, and the first rotating shaft 2112 of the first frame 21 and the second recess 22111 of the second protrusion structure 2211 of the second frame 22 are engaged with each other. In addition, the bent segments 421 of the two first linkage bars 40 are slidably inserted into the outer first sliding grooves 214 of the corresponding first frames 21 and the outer second sliding grooves 224 of the corresponding second frames 22.

Please refer to FIG. 6(*ii*). When an external force F is applied to the top surface 11 of the keycap 10, the second rotating shaft 2212 and the first rotating shaft 2112 are respectively pushed by the first protrusion structure 2111 and the second protrusion structure 2211 (as shown in FIG. 3A). Consequently, the first frame 21 and the second frame 22 are swung relative to the connecting seat 23. When the keycap 10 is moved to the lowermost position, the first rotating shaft 2112 (as shown in FIG. 3A) and the second rotating shaft 2212 are respectively disengaged from the second recess 22111 and the first recess 21111. Moreover, the bent segments 421 in the middle regions of the first sliding grooves 214 and the second sliding grooves 224 are slid to the locations close to the first end part 211 and the third end part 221.

As mentioned above, the rotating shafts are pushed by the corresponding protrusion structures. Consequently, the first frame 21 and the second frame 22 are linked with each other. While the first frame 21 and the second frame 22 are swung, the swinging angles of the first frame 21 and the second frame 22 are continuously equal. Consequently, the keycap can be ascended or descended stably. In other words, regardless of which position of the top surface 11 of the keycap 10 is depressed, the keycap 10 is not aslant moved during the downward movement. Consequently, the operation of the key structure provides good tactile feel.

Please refer to FIG. 7. When the keycap 10 is moved to the lowermost position, the position-limiting ribs 125 are accommodated within the corresponding receiving recesses 232. Consequently, the interference between the position-limiting ribs 125 and the connecting seat 23 will be avoided.

Figure 8:
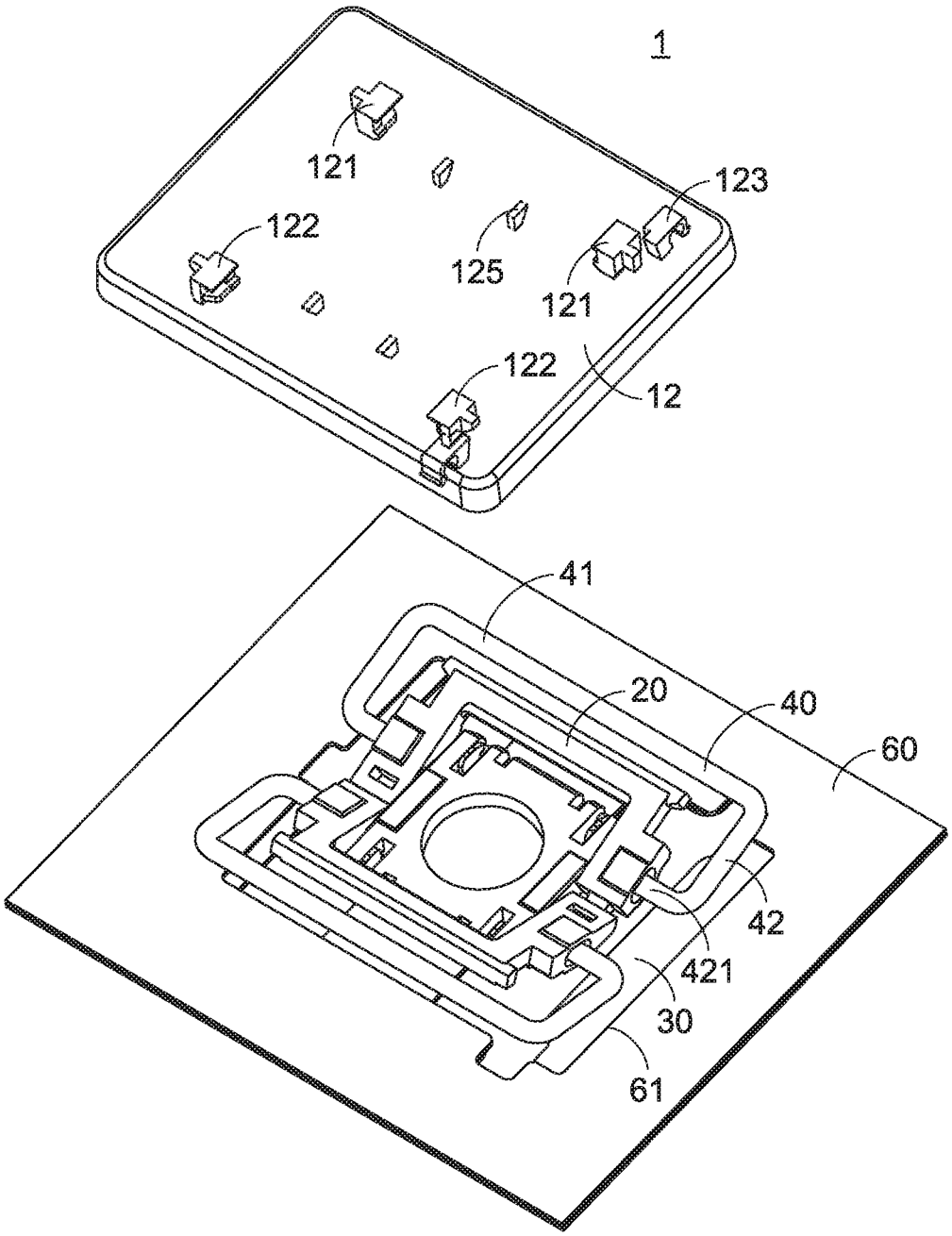
FIG. 8 is a schematic exploded view illustrating a key structure according to a second embodiment of the present invention.

Please refer to FIG. 8. FIG. 8 is a schematic exploded view illustrating a key structure according to a second embodiment of the present invention. In the key structure of this embodiment, the structures and functions of the components which are similar to those of the first embodiment as shown in FIG. 2A are not redundantly described herein. In comparison with the first embodiment, the key structure 1 of this embodiment is an ordinary key with a single wing-type supporting element 20. The bent segments 421 of the two first linkage bars 40 are slidably inserted into the first sliding grooves 214 and the second sliding grooves 224 (see also FIG. 3A), which are formed in the two lateral surfaces of the wing-type supporting element 20. In this embodiment, the key structure 1 comprises two first linkage bars 40. It is noted that the number of the first linkage bars 40 is not restricted. For example, in another embodiment, only one first linkage bar 40 is located beside the first frame 21 or the second frame 22. Alternatively, the key structure is not equipped with any first linkage bar 40.

Figure 9:
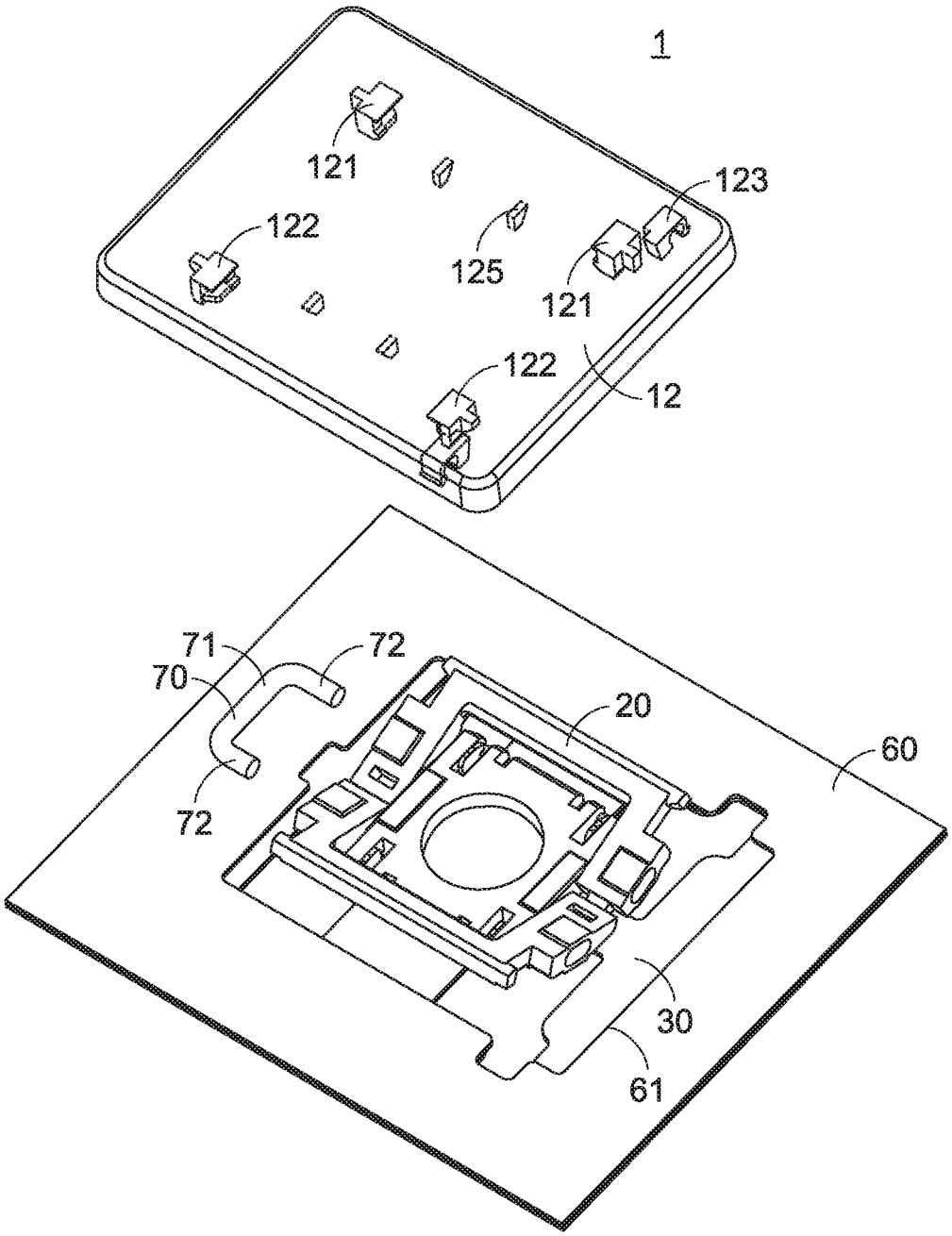
FIG. 9 is a schematic exploded view illustrating a key structure according to a third embodiment of the present invention.

FIG. 9 is a schematic exploded view illustrating a key structure according to a third embodiment of the present invention. In the key structure of this embodiment, the structures and functions of the components which are similar to those of the second embodiment as shown in FIG. 8 are not redundantly described herein. In comparison with the second embodiment, the key structure 1 of this embodiment further comprises a second linkage bar 70. The second linkage bar 70 comprises a transverse bar part 71 and two branch bar part parts 72. The two branch bar part parts 72 are respectively located at two ends of the transverse bar part 71 and perpendicular to the transverse bar part 71. The two branch bar part parts 72 are slidably inserted into the first sliding groove 214 and the second sliding groove 224 (see also FIG. 3A), which are formed in the same lateral surface of the wing-type supporting element 20. The use of the second linkage bar 70 can increase the structural strength of the wing-type supporting element 20. Consequently, the first frame 21 and the second frame 22 are swung more stably.

Figure 10A:
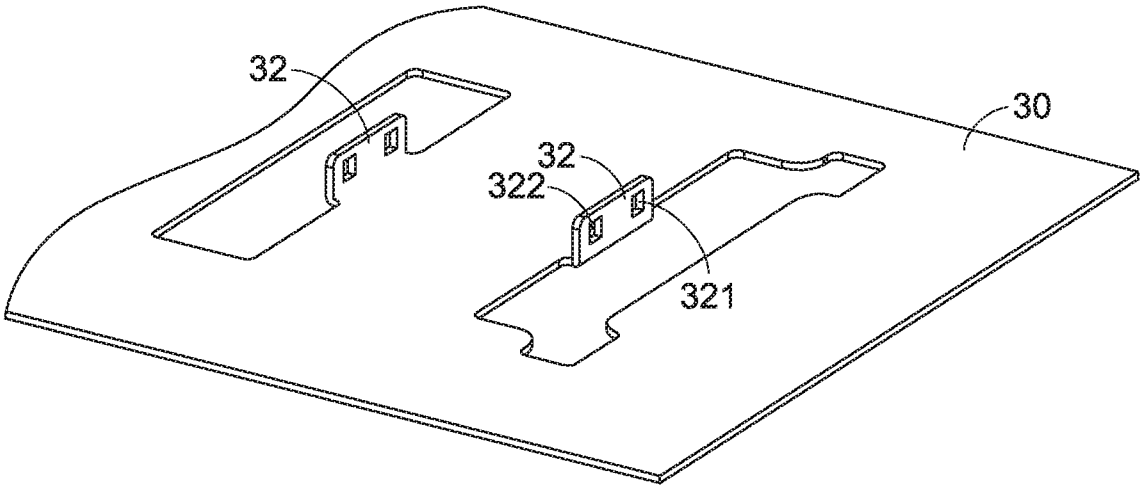
FIG. 10A is a schematic perspective view illustrating a variant example of the base plate used in the key structure of the present invention.
Figure 10B:
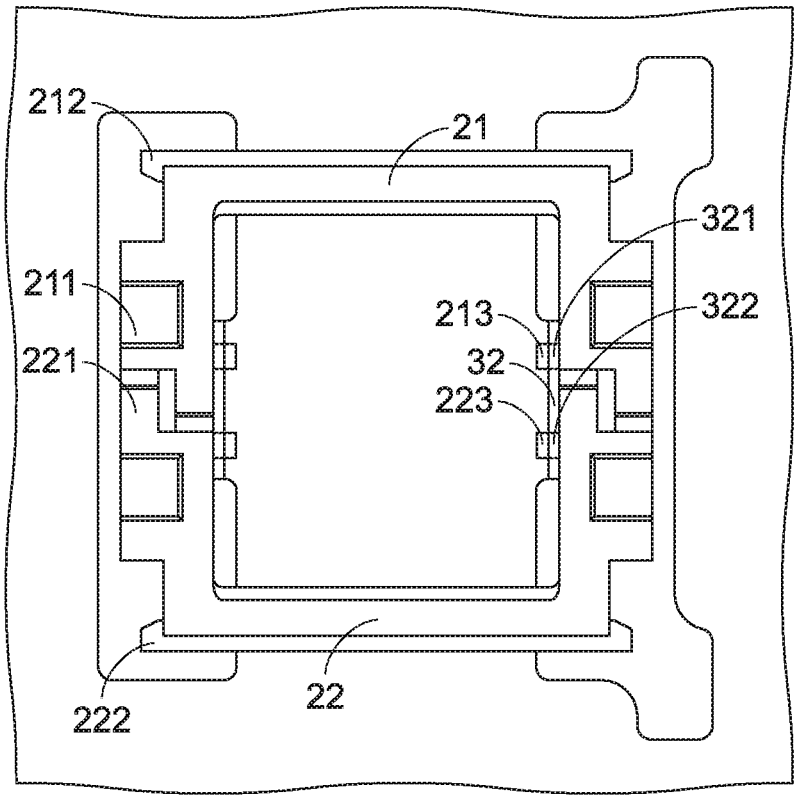
FIG. 10B is a schematic top view illustrating the installation of a second exemplary wing-type supporting element used in the key structure of the present invention.

Please refer to FIGS. 10A and 10B. FIG. 10A is a schematic perspective view illustrating a variant example of the base plate used in the key structure of the present invention. FIG. 10B is a schematic top view illustrating the installation of a second exemplary wing-type supporting element used in the key structure of the present invention. In this embodiment, two coupling structures 32 are protruded upwardly from the base plate 30. Moreover, one first pivotal hole 321 and one second pivotal hole 322 in a side-by-side arrangement are formed in each of the two coupling structures 32. Especially, the wing-type supporting element 20 comprises the first frame 21 and the second frame 22 only. That is, the wing-type supporting element 20 is not equipped with the connecting seat 23. The two first pivotal shafts 213 on the first end part 211 of the first frame 21 are inserted into the corresponding first pivotal holes 321 of the coupling structures 32. The two second pivotal shafts 223 on the third end part 221 of the second frame 22 are inserted into the corresponding second pivotal holes 322 of the coupling structures 32. Consequently, the first frame 21 and the second frame 22 can be swung relative to the base plate 30 in a wing-swinging manner.

From the above descriptions, the present invention provides the key structure. The position-limiting ribs on the bottom surface of the keycap are contacted with the corresponding position-limiting slants of the wing-type supporting element. Consequently, the rocking condition of the keycap along the horizontal direction is avoided, and the stability of depressing the keycap is enhanced. Moreover, the protrusion structures and the corresponding rotating shafts of the wing-type supporting element are pushed by each other. While the first frame and the second frame of the wing-type supporting element are swung, the swinging angles of the first frame and the second frame are continuously equal. Since the keycap can be ascended or descended stably and not aslant moved, the operation of the key structure provides good tactile feel. In other words, the key structure of the present invention is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a keycap;

a base plate; and at least one wing-type supporting element connected with the keycap and the base plate, wherein the keycap is movable upwardly or downwardly relative to the base plate through the at least one wing-type supporting element, and the wing-type supporting element comprises a first frame and a second frame, wherein the first frame comprises a first end part and a second end part opposed to the first end part, and the first end part comprises a first protrusion structure and a first rotating shaft, wherein the second frame comprises a third end part and a fourth end part opposed to the third end part, and the third end part comprises a second protrusion structure corresponding to the first rotating shaft and a second rotating shaft corresponding to the first protrusion structure, wherein the second end part and the fourth end part are slidably connected with the keycap, the first end part and the third end part are located beside each other and pivotally coupled to the base plate, and the first rotating shaft and the second rotating shaft are respectively contacted with the second protrusion structure and the first protrusion structure, wherein when the keycap is depressed in response to an external force, the second rotating shaft and the first rotating shaft are respectively pushed by the first protrusion structure and the second protrusion structure, so that the first frame and the second frame are swung relative to the base plate, wherein the first protrusion structure comprises a first recess formed in a top surface of the first protrusion structure, and the second protrusion structure comprises a second recess formed in a top surface of the second protrusion structure, wherein when the keycap is not depressed in response to the external force, the first rotating shaft and the second rotating shaft are respectively engaged with the second recess and the first recess, wherein when the keycap is depressed in response to the external force and the keycap is moved to a lowermost position, the first rotating shaft and the second rotating shaft are respectively disengaged from the second recess and the first recess.

2. The key structure according to claim 1, wherein at least two position-limiting ribs are disposed on a bottom surface of the keycap, and each position-limiting rib has a first position-limiting slant.

3. The key structure according to claim 2, wherein each of the second end part and the fourth end part comprises a second position-limiting slant corresponding to the first position-limiting slant, wherein when the keycap is not depressed in response to the external force, the first position-limiting slants and the corresponding second position-limiting slants are contacted with each other, so that the keycap is not rocked along a horizontal direction.

4. The key structure according to claim 1, wherein two coupling structures are protruded upwardly from the base plate and aligned with each other, and one first pivotal hole and one second pivotal hole in a side-by-side arrangement are formed in each of the two coupling structures.

5. The key structure according to claim 4, wherein two first pivotal shafts are respectively formed on two opposite inner surfaces of the first end part, two second pivotal shafts are respectively formed on two opposite inner surfaces of the third end part, the two first pivotal shafts are respectively penetrated through the corresponding first pivotal holes, and the two second pivotal shafts are respectively penetrated through the corresponding second pivotal holes.

6. The key structure according to claim 2, wherein the wing-type supporting element further comprises a connecting seat, wherein the first end part and the third end part are pivotally coupled to the connecting seat, and the connecting seat is fixed on the base plate.

7. The key structure according to claim 6, wherein the connecting seat has a first lateral surface and a second lateral surface, and the first lateral surface and the second lateral surface are opposed to each other, wherein one first pivotal hole and one second pivotal hole in a side-by-side arrangement are formed in each of the first lateral surface and the second lateral surface of the connecting seat.

8. The key structure according to claim 7, wherein two first pivotal shafts are respectively formed on two opposite inner surfaces of the first end part, two second pivotal shafts are respectively formed on two opposite inner surfaces of the third end part, the two first pivotal shafts are respectively penetrated through the corresponding first pivotal holes, and the two second pivotal shafts are respectively penetrated through the corresponding second pivotal holes.

9. The key structure according to claim 7, wherein the connecting seat further has a third lateral surface and a fourth lateral surface, and the third lateral surface and the fourth lateral surface are opposed to each other, wherein at least two locking grooves are formed in each of the third lateral surface and the fourth lateral surface of the connecting seat, and one locking post is disposed within each locking groove.

10. The key structure according to claim 9, wherein plural hook structures are protruded upwardly from the base plate and aligned with the corresponding locking grooves, wherein the hook structures are penetrated through the corresponding locking grooves and engaged with the corresponding locking posts, so that the connecting seat is fixed on the base plate.

11. The key structure according to claim 7, wherein the connecting seat further has a third lateral surface and a fourth lateral surface, and the third lateral surface and the fourth lateral surface are opposed to each other, wherein at least one receiving recess is formed in each of the third lateral surface and the fourth lateral surface of the connecting seat and aligned with the corresponding position-limiting ribs, wherein when the keycap is depressed in response to the external force and the keycap is moved to the lowermost position, each position-limiting rib is accommodated within the corresponding receiving recess, so that the at least two position-limiting ribs and the connecting seat are not interfered by each other.

12. The key structure according to claim 1, wherein two first sliding grooves are respectively formed in two opposite lateral surfaces of the first frame, and two second sliding grooves are respectively formed in two opposite lateral surfaces of the second frame.

13. The key structure according to claim 12, wherein the key structure further comprises at least one first linkage bar, and the first linkage bar comprises a transverse bar part and two branch bar parts, wherein the two branch bar parts are perpendicular to the transverse bar part and respectively connected to two ends of the transverse bar part, and a distant end of each branch bar part comprises a bent segment, wherein the bent segment is in parallel with the transverse bar part.

14. The key structure according to claim 13, wherein the transverse bar part is pivotally coupled to the keycap, and each bent segment is inserted into the corresponding first sliding groove or the corresponding second sliding groove.

15. The key structure according to claim 14, wherein at least one locking part is formed on a bottom surface of the keycap, and the transverse bar part is penetrated through the at least one locking part, so that the transverse bar is rotatable relative to the keycap.

16. The key structure according to claim 12, wherein the key structure further comprises at least one second linkage bar, and the second linkage bar comprises a transverse bar part and two branch bar parts, wherein the two branch bar parts are perpendicular to the transverse bar part and respectively connected to two ends of the transverse bar part, wherein the two branch bar parts are inserted into the corresponding first sliding groove and the corresponding second sliding groove, respectively.

17. The key structure according to claim 1, wherein a first movable hook and a second movable hook are disposed on a bottom surface of the keycap, wherein the second end part is slidably engaged with the first movable hook, and the fourth end part is slidably engaged with the second movable hook.

* * * * *